US009976244B2

(12) United States Patent
Yang et al.

(10) Patent No.: US 9,976,244 B2
(45) Date of Patent: May 22, 2018

(54) LAUNDRY TREATMENT APPARATUS

(71) Applicant: LG ELECTRONICS INC., Seoul (KR)

(72) Inventors: Jinho Yang, Seoul (KR); Bokyung Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 206 days.

(21) Appl. No.: 14/691,757

(22) Filed: Apr. 21, 2015

(65) Prior Publication Data

US 2015/0299931 A1 Oct. 22, 2015

(30) Foreign Application Priority Data

Apr. 21, 2014 (KR) ..... 10-2014-0047651

(51) Int. Cl.
*D06F 39/00* (2006.01)
*F21V 33/00* (2006.01)
*H01H 19/02* (2006.01)

(52) U.S. Cl.
CPC ..... *D06F 39/005* (2013.01); *F21V 33/0044* (2013.01); *D06F 2216/00* (2013.01); *H01H 19/025* (2013.01)

(58) Field of Classification Search
CPC ..... D06F 39/005; F21V 33/0044; A47L 9/30
See application file for complete search history.

(56) References Cited

U.S. PATENT DOCUMENTS 7,222,979 B1 * 5/2007 Popowich ..... H01H 19/025 200/316
2003/0024796 A1 2/2003 Peterson
2008/0062673 A1 * 3/2008 Hwang ..... D06F 39/005 362/85
2009/0217712 A1 9/2009 Kim
2012/0260844 A1 * 10/2012 Ross, Jr. ..... G01F 23/00 116/227
2013/0271950 A1 10/2013 Park
2015/0049455 A1 * 2/2015 Heater ..... A47L 15/4293 362/23.13
2015/0062866 A1 3/2015 Park

FOREIGN PATENT DOCUMENTS

EP 2 650 422 A1 10/2013
WO WO 20071043838 A1 4/2007

OTHER PUBLICATIONS

European Search Report dated Aug. 21, 2015, for European Application No. 15164514.0, 7 pages.

* cited by examiner

*Primary Examiner* — Anh Mai
*Assistant Examiner* — Zachary J Snyder
(74) *Attorney, Agent, or Firm* — Fish & Richardson P.C.

(57) ABSTRACT

A laundry treatment apparatus is described. The laundry treatment apparatus includes a rotary control. The laundry treatment apparatus further includes a lighting surface that includes a plurality of first parts that have a first translucence, where a first set of the first parts that are located at lower positions of the circumference have shorter arc lengths than a second set of the first parts that are located at upper positions of the circumference.

5 Claims, 8 Drawing Sheets

LAUNDRY TREATMENT APPARATUS

CROSS-REFERENCE TO RELATED APPLICATION

This application claims priority under 35 U.S.C. § 119 to Korean Patent Application No. 10-2014-0047651, filed on Apr. 21, 2014 in the Korean Intellectual Property Office, whose entire disclosure is incorporated herein by reference.

FIELD

This application relates to a laundry treatment apparatus.

BACKGROUND

In general, a laundry treatment apparatus is an apparatus that applies physical and chemical actions to laundry for treating the laundry. The laundry treatment apparatus includes a washer for removing contaminants from laundry, a spin-dryer for rotating a washing tub, in which laundry is placed, to spin-dry the laundry, and a dryer for supplying cool air or hot air into a washing tub to dry wet laundry.

The laundry treatment apparatus is provided with a control panel having various input means for allowing a user to manipulate the laundry treatment apparatus. In particular, a rotary switch may be mounted at the control panel. Menus selected by the rotary switch may be displayed around the rotary switch. In addition, a plurality of light sources assigned to the respective menus may be mounted at the control panel. The light sources may be turned on according to rotation of the rotary switch to indicate currently selected menus.

In general, the surface of the control panel on which the menus are displayed is directed ahead of the laundry treatment apparatus such that a user located ahead of the laundry treatment apparatus can easily manipulate the rotary switch. The light sources are arranged along a predetermined circumference. Bright parts are formed on the surface on which the menus are displayed by light emitted from the light sources. The positions of the bright parts function to indicate currently selected menus.

SUMMARY

According to an innovative aspect of the subject matter described in this application, a laundry treatment apparatus includes a rotary control; and a lighting surface that includes a plurality of first parts that have a first translucence, where a first set of the first parts that are located at lower positions of the circumference have shorter arc lengths than a second set of the first parts that are located at upper positions of the circumference.

The laundry treatment apparatus may include one or more of the following optional features. The first set of the first parts are located within a visual angle increase section of the circumference, and the visual angle increase section includes a section of the circumference in which visual angles to arc segments on the circumference that have a same length gradually increase when viewed from above as the arc segments have lower positions on the circumference. The laundry treatment apparatus further includes a control panel that includes the lighting surface; a plurality of light sources that are located along the circumference and that are configured to blink the first parts along the circumference in response to a rotation of the rotary control; and a light guide that is located inside the control panel, that defines a light source receiving space around a circumference of the light guide, and that includes a plurality of division walls that divide the light source receiving space into a plurality of receiving units that are each configured to receive at least one of the plurality of light sources.

A first set of the receiving units that are located at lower positions of the circumference and that correspond to the first set of the bright parts are configured to have shorter arc lengths than a second set of the receiving units that are located at upper positions of the circumference. A first set of the division walls that are located at lower positions of the circumference and that are configured to divide the receiving units that correspond to the first set of the first parts have longer arc lengths than a second set of the division walls that are located at lower positions of the circumference.

The laundry treatment apparatus further includes a window that includes an incident surface, upon which light emitted from the plurality of light sources is incident, and a light path that is configured to guide the incident light to the lighting surface, where the window includes light transmission regions that each correspond to a respective receiving unit and light shielding regions each located between respective light transmission regions, the light transmission regions each being configured to transmit light emitted from a respective light source to a respective first part, the light shielding regions each being configured to transmit light emitted from the respective light source to a respective second part of the lighting surface that has a second translucence that is lower than the first translucence. Some of the light shielding regions located in the visual angle increase section have gradually increasing arc lengths as the light shielding regions have lower positions of the circumference.

Some of the light transmission regions located in the visual angle increase section have gradually decreasing arc lengths as the light transmission regions have lower positions of the circumference. The rotary control is configured to select menus on the control panel. The lighting surface includes an indication region that is configured to indicate, using the first parts, a selected menu and a non-indication region that is different from the indication region. The first set of the first parts are located in the indication region.

According to another innovative aspect of the subject matter described in this application, a laundry treatment apparatus includes a rotary control; and a lighting surface that includes a plurality of first parts that have a first translucence, where based on the circumference being viewed from a predetermined visual point located above the lighting surface, some of the first parts, located in a visual angle increase section of the circumference, and where visual angles, to arc segments on the circumference that have a same length gradually increase as the arc segments are gradually more distant from the visual point, have shorter arc lengths along the circumference as the first parts are more distant from the predetermined visual point.

The laundry treatment apparatus may include one or more of the following optional features. The rotary control is a rotary knob. The lighting surface has a plurality of second parts that have a second translucence that is lower than the first translucence. The laundry treatment apparatus further includes a plurality of light sources that are located along the circumference and that are configured to blink the first parts along the circumference in response to a rotation of the rotary control.

It is an object of the subject matter described in this application to provide a laundry treatment apparatus that is capable of enabling a user to correctly recognize a menu selected according to rotation of a rotary knob.

DETAILED DESCRIPTION

Figure 1:
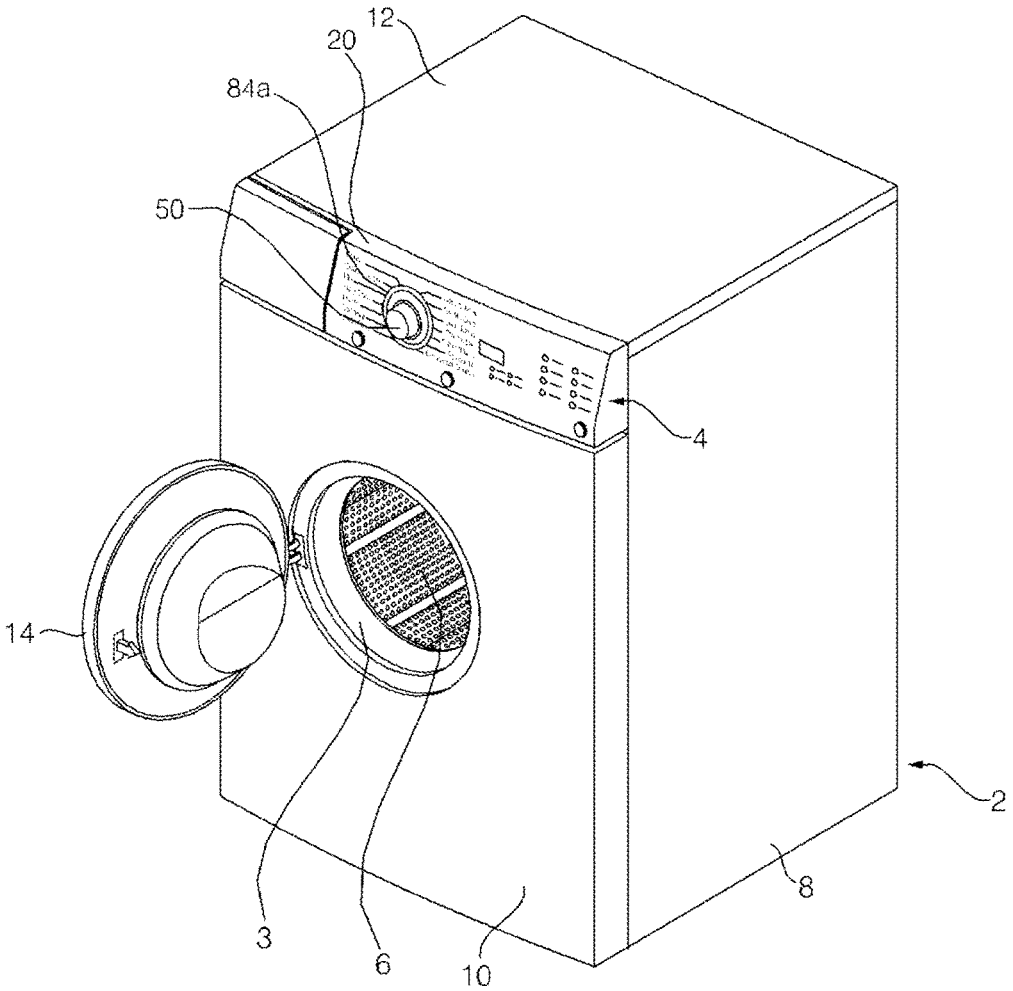
FIG. 1 is a perspective view of a laundry treatment apparatus.
Figure 2:
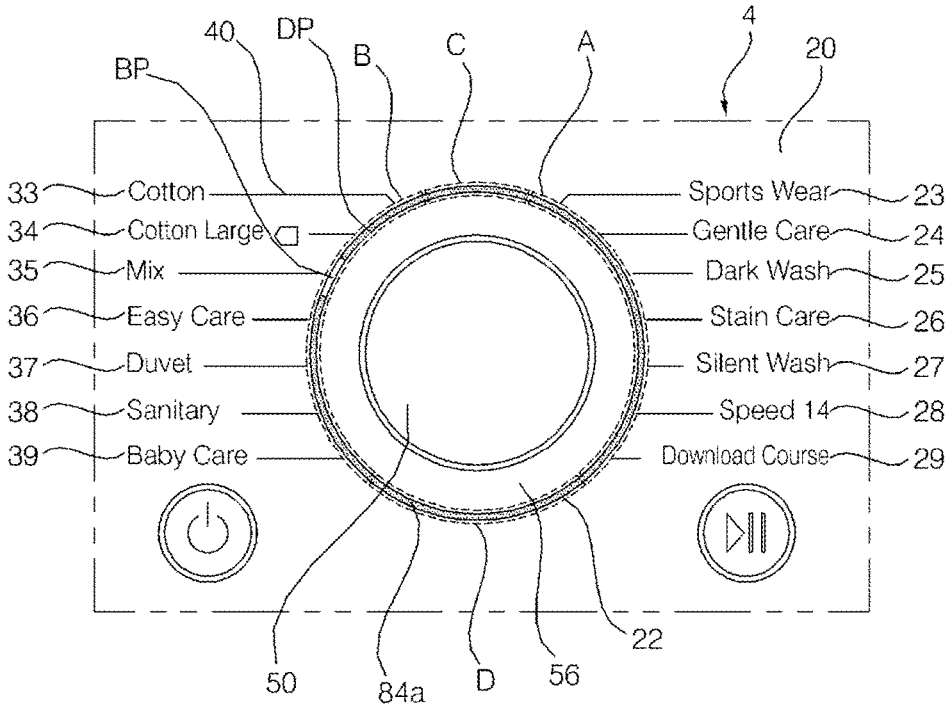
FIG. 2 is an enlarged view of a control panel.

FIG. 1 illustrates an example laundry treatment apparatus. FIG. 2 illustrates an example control panel. Referring to FIGS. 1 and 2, the laundry treatment apparatus may include a cabinet 2 forming the external appearance of the laundry treatment apparatus and a control panel 4 supported by the cabinet 2.

The cabinet 2 is provided at the inside thereof with a space, in which a drum 6 for receiving laundry is disposed. Other components, such as a motor and a pump, are disposed in the cabinet 2. Furthermore, the cabinet 2 may be provided with a laundry introduction port 3, through which laundry is introduced into the cabinet 2.

The cabinet 2 may be formed by bending a single member a plurality of times. Alternatively, a plurality of members may be coupled to form the cabinet 2. The cabinet 2 may include a base pan, a cabinet body 8 mounted at the base pan, the cabinet body 8 having a space in which a tub is disposed, a cabinet cover 10 disposed at the front of the cabinet body 8, the laundry introduction port 3 being formed at the cabinet cover 10, and a top cover 12 disposed at the top of the cabinet body 8.

The cabinet body 8 may be formed of a single member or a plurality of members. The cabinet body 8 may include a left cover disposed on the left side of the base pan, a right cover disposed on the right side of the base pan, and a rear cover disposed on the rear side of the base pan.

A door 14 for opening and closing the laundry introduction port 3 may be mounted at the cabinet 2. The door 14 may be rotatably connected to the cabinet 2 for opening and closing the laundry introduction port 3. Alternatively, the door 14 may be slidably connected to the cabinet 2 for opening and closing the laundry introduction port 3. The door 14 may be connected to the cabinet 2 via a hinge mechanism such that the door 14 can be hingedly rotated about the hinge mechanism for opening and closing the laundry introduction port 3.

The control panel 4 may include a manipulation unit for allowing a user to manipulate the laundry treatment apparatus. The control panel 4 may include a display unit for displaying an operation state of the laundry treatment apparatus. The control panel 4 may include both the manipulation unit and the display unit.

The control panel 4 may be mounted at the cabinet 2. The control panel 4 may be disposed at the upper side of the cabinet cover 10. The control panel 4 may be located at the upper part of the front of the cabinet 2. The control panel 4 may form a portion of the external appearance of the laundry treatment apparatus.

The control panel 4 may include a control panel body 20 forming the external appearance of the control panel 4. The control panel body 20 may be located at the upper side of the cabinet cover 10. The manipulation unit, which allows the user to manipulate the laundry treatment apparatus, and the display unit, which displays the operation state of the laundry treatment apparatus, may be disposed at the control panel body 20.

The control panel 4 may include a rotary knob 50. The control panel body 20 is provided at the front thereof with an opening 22, in which the rotary knob 50 is mounted. A plurality of menus 23 to 29 and 33 to 39, which can be selected according to rotation of the rotary knob 50, is displayed around the opening 22. The menus may correspond to courses that can be performed by the laundry treatment apparatus.

The menus 23 to 29 and 33 to 39 are indicated by predetermined indicating lines 40. In a case in which bright parts BP are formed on a lighting surface 84*a* by a plurality of light sources 60, which will hereinafter be described, the indicating lines 40 function to indicate menus corresponding to the bright parts BP.

The control panel 4 may include a knob decoration 56 located around the rotary knob 50. The knob decoration 56 may be located between the outer circumference of the rotary knob 50 and the opening 22. The knob decoration 56 may aesthetically improve the external appearance around the rotary knob 50. The knob decoration 56 may have the same color as the control panel body 20.

Inside the control panel body 20 may be provided a plurality of light sources 60 for emitting light. The light sources 60 are sequentially blinked according to rotation of the rotary knob 50. The control panel 4 may include a window 80 forming bright parts BP using light emitted from the light sources 60. The window 80 may include an incident plate 81 having an incident surface 81*a*, upon which light emitted from the light sources 60 is incident, and a ring-shaped light path 84 protruding from the front of the incident surface 81*a*. As the light path 84 is partially exposed to the outside of the control panel 4 through the opening 22, a ring-shaped lighting surface 84*a* is formed around the rotary knob 50. On the lighting surface 84*a* are formed bright parts BP corresponding to the light sources 60 which are turned on and dark parts DP corresponding to the light sources 60 which are turned off. The positions of the bright parts BP on the window 80 are changed depending upon the positions of the light sources 60 which are blinked. In some implementations, the lighting surface 84*a* is integrally formed at the window 80. In some implementations, the lighting surface 84*a* may be formed of a member separated from the window 80.

The light sources 60 are not necessarily blinked according to rotation of the rotary knob 50. A predetermined lighting pattern may be formed on the window 80. The lighting pattern may be stationary. Alternatively, the lighting pattern may be dynamic. In this case, the shape of the lighting pattern, which is formed by one or more bright parts, may be changed, or the lighting pattern may be moved. In order to achieve various lighting patterns, a larger number of light sources 60 than the menus 23 to 29 and 33 to 39 may be provided. In this case, bright parts may be formed not only on the sections of the window 80 on which the selectable menus 23 to 29 and 33 to 39 are displayed but also on the other sections of the window 80. For example, as shown in FIG. 2, a first menu display region corresponding to the menus 23 to 29 and a second menu display region corresponding to the menus 33 to 39 may be formed on the control panel body 20 at opposite sides of the rotary knob 50. The window 80 may include a first indication region A, on which bright parts BP indicating the menus 23 to 29 on the first menu display region are formed, a second indication region B, on which bright parts BP indicating the menus 33 to 39 on the second menu display region are formed, and at least one non-indication region C and D provided between the first indication region A and the second indication region B. In some implementations, the at least one non-indication region includes a first non-indication region C connected between the first indication region A and the second indication region B at the upper part of the window 80, and a second non-indication region D connected between the first indication region A and the second indication region B at the lower part of the window 80.

The non-indication regions C and D are lit by the light sources 60 but do not indicate selectable menus. The non-indication regions C and D may be used to achieve various lighting pattern through the window 80. For example, the non-indication regions C and D may be used as welcome lighting. The welcome lighting may have a predetermined lighting pattern provided on the window 80 when a user pushes a power button of the laundry treatment apparatus. When the welcome lighting is turned on, all of the indication regions A and B and the non-indication regions C and D are lit. As a result, a ring-shaped bright part may be formed over the entire region of the window 80. Alternatively, a dynamic lighting pattern, in which a bright part having a predetermined pattern is moved along the non-indication regions C and D as well as the indication regions A and B, may be formed on the window 80.

Figure 3:
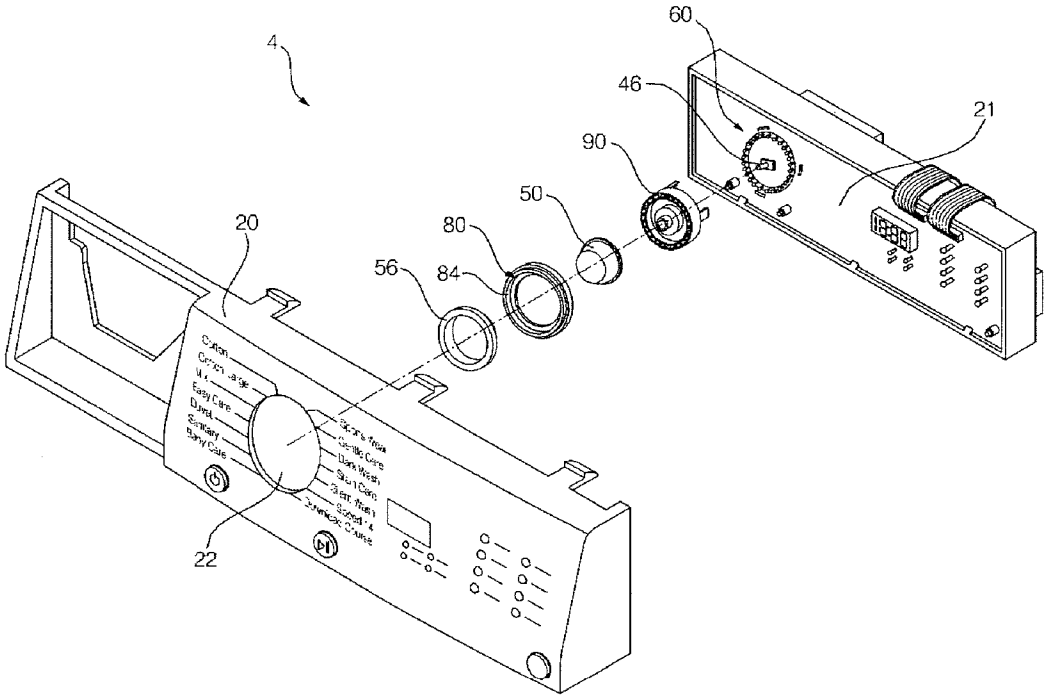
FIG. 3 is an exploded perspective view of a control panel.
Figure 4:
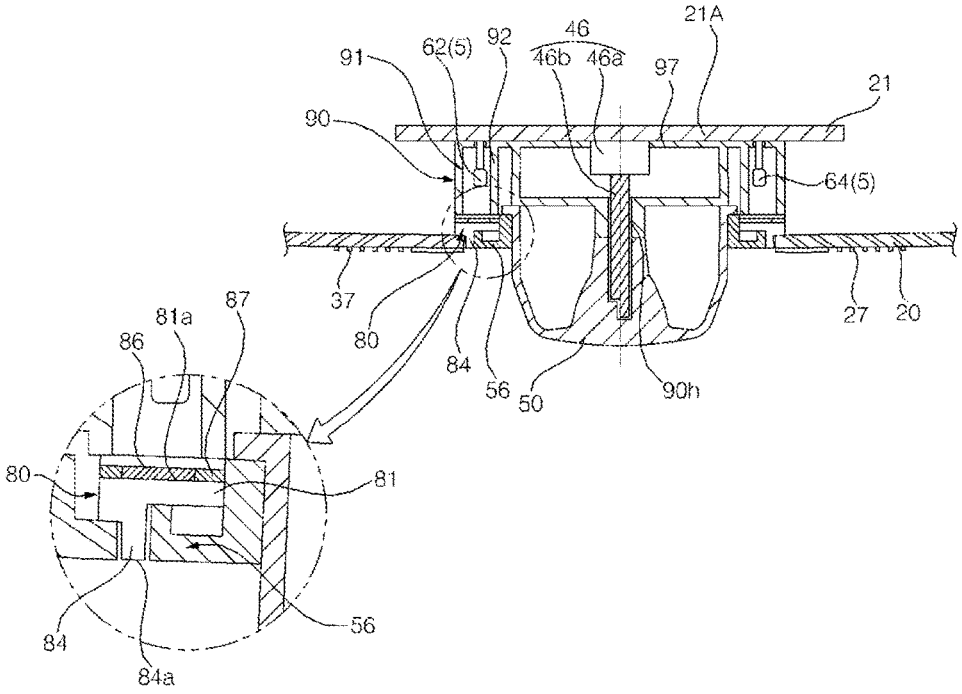
FIG. 4 is a cross sectional view of main components of a control panel.
Figure 5:
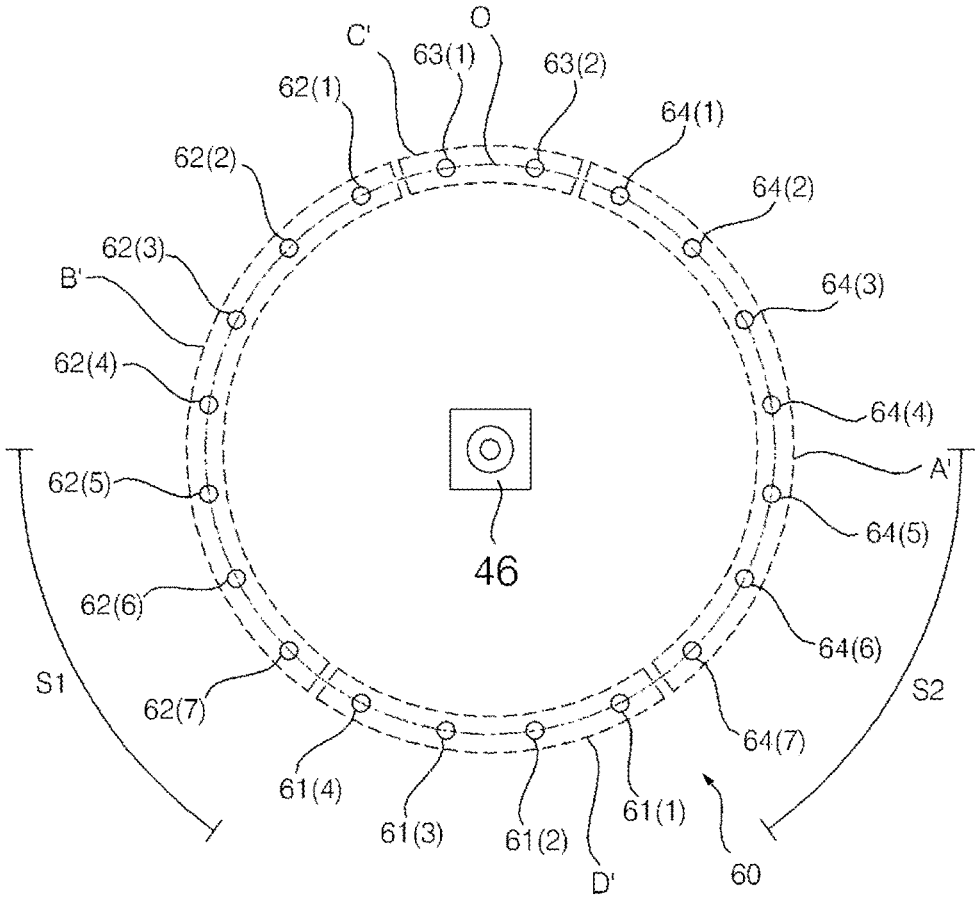
FIG. 5 illustrates an array of light sources.
Figure 6:
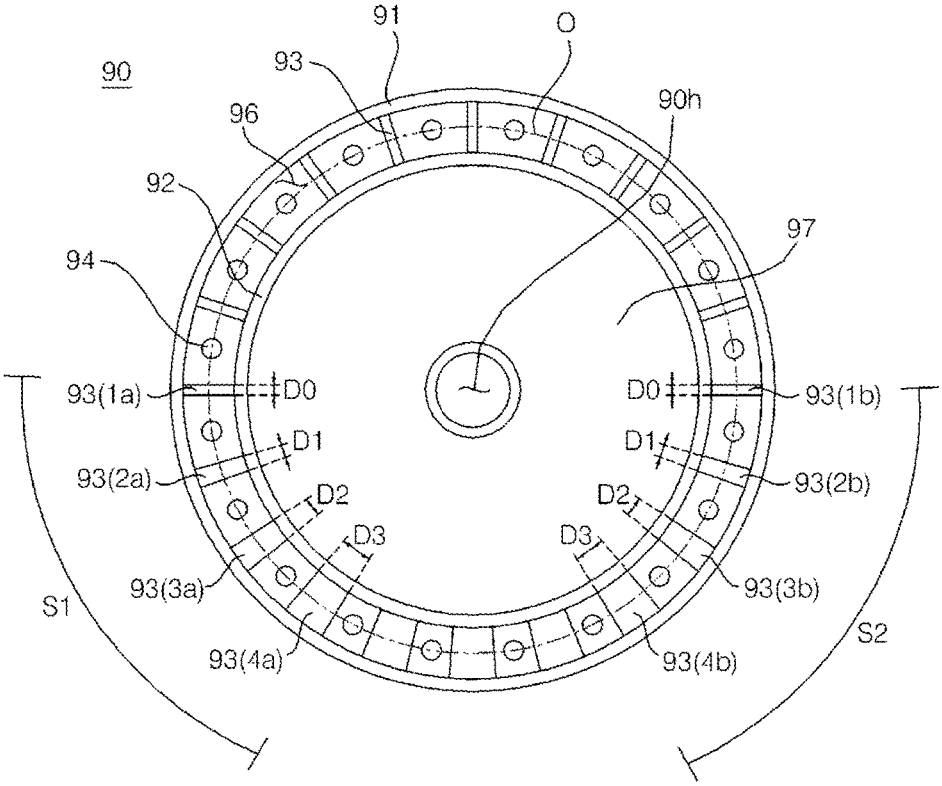
FIG. 6 illustrates light source receiving units.
Figure 7A:
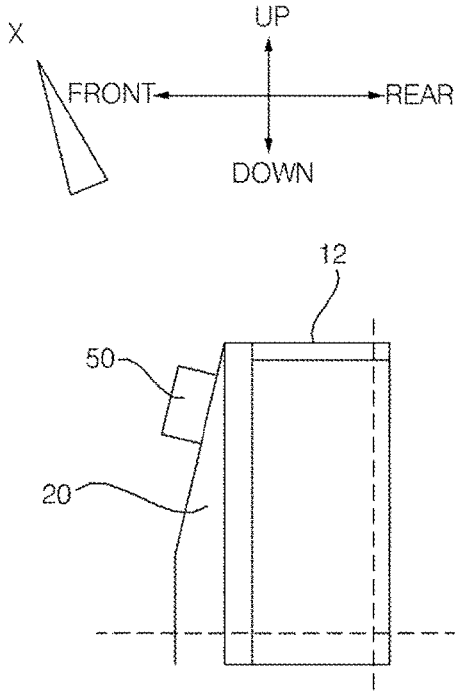
FIG. 7 is a side view of the control panel (a) and a reference view (b) illustrating a principle in which a visual angle difference occurs depending upon a position of an arc segment on a circumference.
Figure 7B:
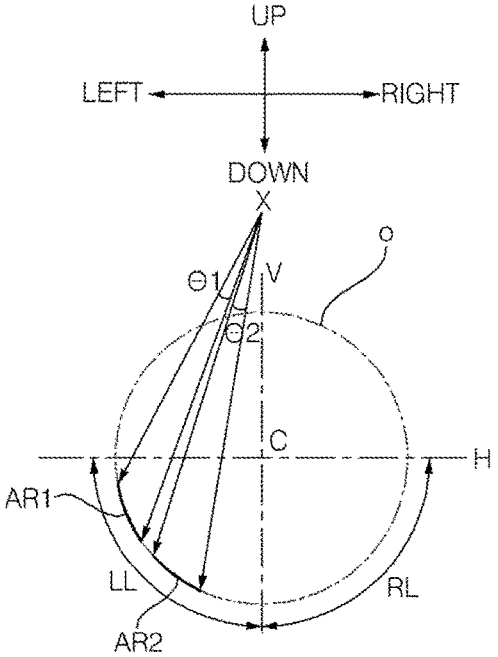
Figure 8:
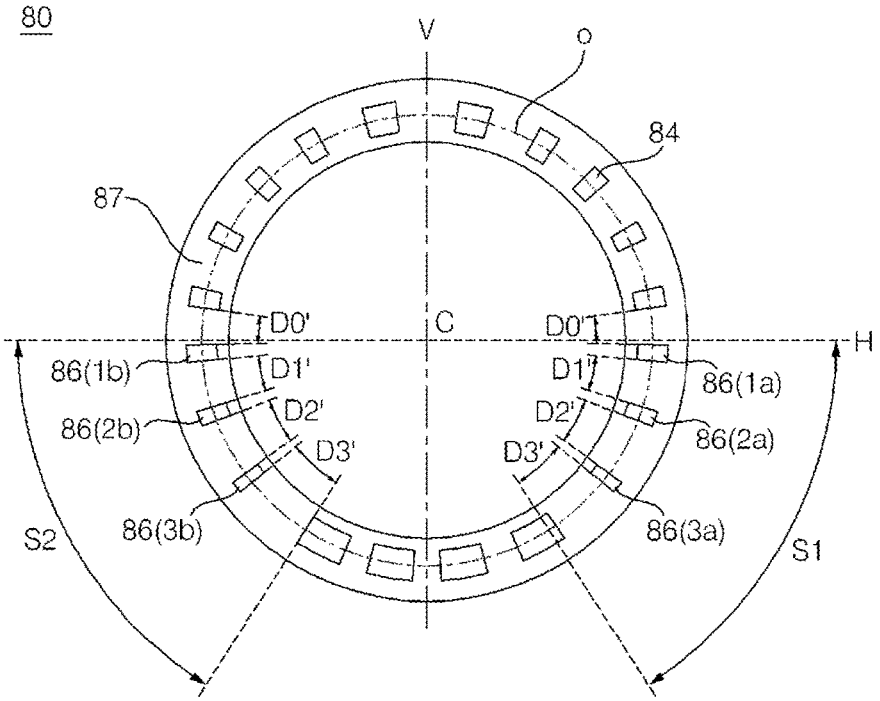
FIG. 8 illustrates a back surface of a window.

FIG. 3 illustrates of an example control panel. FIG. 4 illustrates example main components of a control panel. FIG. 5 illustrates an example array of light sources. FIG. 6 illustrates example light source receiving units. FIG. 7 illustrates an example of a side view of a control panel (a) and a reference view (b). FIG. 8 illustrates an example window.

Referring to FIGS. 3 to 5, a circuit board 21 may be disposed at the inside of the control panel 4, and the light sources 60 may be arranged on the circuit board 21 in the shape of a circle. The circuit board 21 may be a printed circuit board. In addition, a rotary switch 46 may be mounted at the circuit board 21. The rotary switch 46 may include a rotary shaft 46*b*, to which the rotary knob 50 is connected, a switching device 46*a* for switching a predetermined circuit formed at the circuit board 21 to turn on or off the light sources 60.

Referring to FIG. 5, the light sources 60 are divided into groups. Light sources 64(1) to 64(7) belonging to a group A', light sources 62(1) to 62(7) belonging to a group B', light sources 63(1) and 63(2) belonging to a group C', and light sources 61(1) to 61(4) belonging to a group D' form bright parts on the indication region A, the indication region B, the non-indication region C, and the non-indication region D of FIG. 2, respectively.

The laundry treatment apparatus may further include a light guide 90. The light guide 90 guides light emitted from the light sources 60 such that the light is intensively incident upon the incident surface 81*a* of the window 80. The light guide 90 may include a base 97 having through holes 94, through which light emitted from the light sources 60 disposed at the rear of the light guide 90 passes, formed along a circumference O thereof, a ring-shaped inner circumferential partition wall 92 and a ring-shaped outer circumferential partition wall 91 protruding from the front of the base 97, and a plurality of division walls 93 connected between the inner circumferential partition wall 92 and the outer circumferential partition wall 91. The through holes 94 are located between the inner circumferential partition wall 92 and the outer circumferential partition wall 91. Each of the light sources 60 exposed through the through holes 94 is received in a light source receiving unit 96 defined by the inner circumferential partition wall 92, the outer circumferential partition wall 91, and a pair of the division walls 93. At least one of the light sources may be received in each light source receiving unit 96. The division walls 93 may be provided to form a plurality of light source receiving units corresponding to the number of the menus. In some implementations, spaces for receiving the light sources 60 are provided by the division walls 93 even in the sections corresponding to the non-indication regions C and D. Since each of the light sources 60 in a corresponding one of the light source receiving units 96 is surrounded by the inner circumferential partition wall 92, the outer circumferential partition wall 91, and a pair of the division walls 93, it is possible to prevent light from being dispersed to a region other than the incident surface 81*a* of the window 80.

Meanwhile, the base 97 may be provided with a through hole 90*h*, through which the rotary shaft 46*b* of the rotary switch 46 extends.

Referring to FIG. 8, the window 80 is provided with a light transmission region 86 and a light shielding region 87. In some implementations, the light transmission region 86 and the light shielding region 87 are formed at the incident surface 81*a* of the window 80. In some implementations, the light transmission region 86 and the light shielding region 87 may be formed at the lighting surface 84*a* of the window 80 or the front of the window 80 from which the light path 84 protrudes.

A plurality of light transmission regions 86 is formed along a circumference O of the window 80. Light shielding regions 87 are located between neighboring ones of the light transmission regions 86. The light transmission regions 86 correspond to the respective light source receiving units 96 of the light guide 90. Consequently, one bright part BP is formed by one light source 60 located in each light source receiving unit 96 and one light transmission region 86 corresponding thereto, and light emitted from the light source 60 is prevented from being transmitted through adjacent light transmission regions 86 by the division walls 93 of the light guide 90.

The light transmission regions 86 and the light shielding regions 87 have different light transmissivities. The light transmission regions 86 transmit light at a higher rate than the light shielding regions 87. Light transmitted through the light transmission regions 86 forms bright parts BP on the lighting surface 84*a* of the window 80, and the light shielding regions 87 form dark parts DP on the lighting surface 84*a* of the window 80. Although the light shielding regions 87 do not completely shield light, it is necessary for the light shielding regions 87 to exhibit sufficient light shieldability to distinguish between the dark parts DP and the bright parts BP. Particularly in a case in which the light shielding regions 87 exhibit high light shieldability, boundaries between the bright parts due to the dark parts become distinct with the result that it is difficult to achieve a pattern having unity. For this reason, the light shielding regions 87 may transmit light to some extent. The light shielding regions 87 may be formed over the entire region of the incident surface 81*a* of the window 80 excluding the light transmission regions 86.

The window 80 may be formed of a transparent material. A paint exhibiting high light shieldability may be applied to the entire region of the transparent incident surface 81*a* of the window 80 excluding the light transmission regions 86 to form the light shielding regions 87. Alternatively, a paint exhibiting high light shieldability may be applied to the transparent incident surface 81*a*, and then the paint may be removed from portions of the incident surface 31*a* corresponding to the light shielding regions 87 using a solvent.

In addition, a paint may also be applied to the lighting surface 84*a* of the window 80. The paint applied to the lighting surface 84*a* of the window 80 exhibits higher light transmissivity than that applied to form the light shielding regions 87. Consequently, light transmitted through the light transmission regions 86 may pass through the paint layer to form bright parts on the lighting surface 84*a* of the window 80. Since at least a portion of the lighting surface 84*a* of the window 80 is exposed to the outside of the control panel 4, the external appearance of the laundry treatment apparatus is aesthetically improved by the applied paint. In addition, dim bright parts BP are formed on the lighting surface 84*a* of the window 80.

According to rotation of the rotary knob 50, the bright parts BP are sequentially blinked on the lighting surface 84*a* of the window 80 along a circumference O thereof. At this time, at least some of the bright parts BP are configured such that the bright parts BP located at lower positions along the circumference O have shorter lengths to occupy the circumference O (hereinafter, referred to as bright part lengths).

FIG. 7 is a side view of the control panel (a) and a reference view illustrating a principle in which a visual angle difference occurs depending upon the position of an arc segment on a circumference. Referring to FIG. 7, in a structure in which the front of the control panel 4, specifically the control panel body 20 on which the menus are displayed, is directed ahead of the laundry treatment apparatus, a user located ahead of the laundry treatment apparatus generally looks down the lighting surface 84*a* of the window 80 in consideration of heights of the user and the laundry treatment apparatus. (X of FIG. 7(*a*) indicates a visual point of the user.) In this case, since the lighting surface 84*a* of the window 80 extends along a circumference O (hereinafter, the circumference will be defined as a circle or an arc), the bright part lengths recognized by the user are changed depending upon the positions of the bright parts BP on the circumference O.

For example, referring to FIG. 7(*b*), when a first arc segment AR1 and a second arc segment AR2, which actually have the same length on the circumference O, are viewed from the same visual point X, a visual angle θ2 to the second arc segment AR2 is greater than a visual angle θ2 to the first arc segment AR1. This is because the first arc segment AR1 or the second arc segment AR2 is taken from the circumference O. The user recognizes that a lower arc segment, i.e. the second arc segment AR2, is longer than a higher arc segment, i.e. first arc segment AR1, within a specific section of the circumference O. Hereinafter, on the assumption that arc segments have the same length, a section of the circumference O in which a lower arc segment seems to be longer will be defined as a visual angle increase section. On the other hand, when the user looks down the circumference O from the view point X located above the lighting surface 84*a* of the window 80, the visual angle increase section may be defined as a section of the circumference O in which visual angles to the arc segments having the same length on the circumference O are gradually increased as the arc segments are gradually more distant from the view point X.

The visual angle increase section may be changed depending upon the position of the view point X of the user. Considering that a general view point X of the user is above the front of the laundry treatment apparatus, however, visual angle increase sections may be formed at opposite sides of the lower part of the circumference O, i.e. the region of the circumference O below a horizontal center line H, on the basis of a vertical center line V (LL and RL).

In the laundry treatment apparatus, the bright parts BP are sequentially blinked on the lighting surface 84*a* of the window 80 along the circumference O thereof according to rotation of the rotary knob 50. At this time, at least some of the bright parts BP are configured such that the bright parts BP located at lower positions along the circumference O have shorter lengths to occupy the circumference O (hereinafter, referred to as bright part lengths).

In particular, the bright parts BP seem to be longer in the visual angle increase sections LL and RL. As a result, light spreading in the left and right directions is excessive, and therefore it is not possible to clearly recognize which menus are indicated by the bright parts BP. Consequently, it is necessary to decide the bright part lengths in consideration of a light spreading phenomenon in parts S1 and S2 belonging to the visual angle increase sections LL and RL of the indication regions A and B of the lighting surface 84*a* of the window 80. From this point of view, the bright parts BP located at lower positions may have shorter bright part in the indication regions S1 and S2 belonging to the visual angle increase sections LL and RL.

Referring to FIG. 6, the light guide 90 is configured such that at least some of the division walls 93(1*a*), 93(2*a*), 93(3*a*), 93(4*a*), 93(1*b*), 93(2*b*), 93(3*a*), and 93(4*a*) belonging to the indication regions S1 and S2 become thicker toward lower positions (D0<D1<D2<D3). As a result, the light source receiving units 96 defined by the division walls 93(1*a*), 93(2*a*), 93(3*a*), 93(4*a*), 93(1*b*), 93(2*b*), 93(3*a*), and 93(4*a*) are configured such that the light source receiving units 96 located at lower positions have shorter lengths to occupy the circumference O (hereinafter, referred to as receiving unit lengths). In particular, the receiving unit lengths have an influence on a light diffusion range. Consequently, light spreading is reduced as the receiving unit lengths are decreased, whereby it is possible to clearly recognize which menus are indicated by the bright parts BP. In addition, in a case in which the receiving unit lengths are set as described above, the bright part lengths are set in response to the receiving unit lengths although the light transmission regions 86 and the light shielding regions 87 are not formed on the incident surface 81*a* of the window 80, thereby improving menu discrimination. In addition, the lengths of the light transmission regions 86 on the incident surface 81*a* of the window 80 to occupy the circumference O (hereinafter, referred to as light transmission region lengths) and the lengths of the light shielding regions 87 on the incident surface 81*a* to occupy the circumference O (hereinafter, referred to as light shielding region lengths) may also be set in response to the receiving unit lengths and the change in thickness of the division walls. FIG. 8 shows an example of the above-described array. Referring to FIG. 8, the light shielding region lengths on the indication regions S1 and S2 are gradually increased toward lower positions in response to the change in thickness of the division walls 84(1*a*), 84(2*a*), 84(3*a*), 84(1*b*), 84(2*b*), and 84(3*b*) (D0'<D1'<D2'<D3'). On the other hand, the light transmission region lengths are gradually decreased toward lower positions (see 86(1*a*) to 86(3*a*) and 86(1*b*) to 86(3*b*)).

The laundry treatment apparatus has the effect of enabling a user to correctly recognize a menu selected according to rotation of the rotary knob. Particularly in a case in which the control panel is mounted at the laundry treatment apparatus such that the user located ahead of the laundry treatment apparatus looks down the control panel, it is possible to improve discrimination among menus.

In addition, it is possible for the user to intuitively recognize a currently selected menu through blinking of the light sources assigned to the respective menus. Furthermore, it is possible to compensate for a discrimination error due to a visual angle difference of the user. Consequently, the laundry treatment apparatus has the effect of enabling the user to correctly recognize the menu indicated by lighting.

What is claimed is:

1. A laundry treatment apparatus comprising:

a rotary control;

a lighting surface that includes a plurality of first parts that have a first translucence;

a control panel that includes the lighting surface;

a plurality of light sources that are located along a circumference around the rotary control and that are configured to blink the first parts in response to a rotation of the rotary control; and a light guide that is located inside the control panel, that defines a light source receiving space around a circumference of the light guide, and that includes a plurality of division walls that divide the light source receiving space into a plurality of receiving units that are each configured to receive at least one of the plurality of light sources, wherein a first set of the first parts are located within a visual angle increase section of the circumference, the visual angle increase section comprising a section of the circumference in which visual angles to arc segments on the circumference and having a same length increase as the arc segments are more distant from a predetermined view point in an acute angle with the lighting surface, based on viewing the visual angle increase section from the predetermined view point, wherein arc lengths of the first set of the first parts decrease as the first parts are more distant from the predetermined view point, and the arc lengths of the first set of the first parts appear to be substantially identical based on being viewed from the predetermined view point, wherein a first set of the receiving units that are located within the visual angle increase section of the circumference and that correspond to a first set of bright parts have shorter arc lengths as the receiving units are more distant from the predetermined view point, and wherein a first set of the plurality of division walls that divide the first set of the receiving units have longer arc lengths as the division walls are more distant from the predetermined view point.

2. The laundry treatment apparatus according to claim 1, further comprising:

a window that includes an incident surface, upon which light emitted from the plurality of light sources is incident, and a light path that is configured to guide the incident light to the lighting surface, wherein the window includes light transmission regions that each correspond to a respective receiving unit and light shielding regions each located between respective light transmission regions, the light transmission regions each being configured to transmit light emitted from a respective light source to a respective first part, the light shielding regions each being configured to transmit light emitted from the respective light source to a respective second part of the lighting surface that has a second translucence that is lower than the first translucence.

3. The laundry treatment apparatus according to claim 2, wherein some of the light shielding regions located in the visual angle increase section have gradually increasing arc lengths as the light shielding regions have lower positions of the circumference.

4. The laundry treatment apparatus according to claim 2, wherein some of the light transmission regions located in the visual angle increase section have gradually decreasing arc lengths as the light transmission regions have lower positions of the circumference.

5. The laundry treatment apparatus according to claim 1, wherein:

the rotary control is configured to select menus on the control panel, the lighting surface comprises an indication region that is configured to indicate, using the first parts, a selected menu and a non-indication region that is different from the indication region, and the first set of the first parts are located in the indication region.

* * * * *